US005701617A

United States Patent [19]

Colby

[11] Patent Number: 5,701,617

[45] Date of Patent: Dec. 30, 1997

[54] ABSORBENT BEDSHEET

[76] Inventor: Gerard Joseph Colby, 326 Lonicera Ct., Wilmington, N.C. 28405

[21] Appl. No.: 821,909

[22] Filed: Mar. 21, 1997

[51] Int. Cl.[6] ..... A47G 9/04

[52] U.S. Cl. ..... 5/484; 5/486; 5/923

[58] Field of Search ..... 5/484, 486, 497, 5/499, 500, 923, 495, 502, 482

[56] References Cited

U.S. PATENT DOCUMENTS

| | | | |
|---|---|---|---|
| 2,614,273 | 10/1952 | Yancofski | 5/484 |
| 2,779,035 | 1/1957 | McMurry | 5/484 |
| 4,021,870 | 5/1977 | Walters | 5/484 |
| 4,064,577 | 12/1977 | Walters | 5/484 |
| 4,097,943 | 7/1978 | O'Connell | 5/484 |
| 4,922,565 | 5/1990 | Blake | 5/484 |
| 5,249,320 | 10/1993 | Moretz et al. | 5/484 |
| 5,252,374 | 10/1993 | Larsonneur | 5/484 |

FOREIGN PATENT DOCUMENTS

| | | | |
|---|---|---|---|
| 2235132 | 2/1991 | United Kingdom | 5/484 |

*Primary Examiner*—Alexander Grosz
*Attorney, Agent, or Firm*—Rhodes Coats & Bennett

[57] ABSTRACT

An easily changeable, moisture resistant bedsheet formed of a bottom sheet component having water-permeable upper and lower textile sections, and a moisture-resistant center section; a moisture absorbent pad on the center section; and a textile cover sheet component of the same material as the upper and lower sections of the bottom sheet component releasibly secured over the pad and center section to give the appearance of a conventional single sheet formed of a single textile fabric.

7 Claims, 2 Drawing Sheets

ABSORBENT BEDSHEET

BACKGROUND OF THE INVENTION

1. Field of the Invention

The present invention relates generally to an improved bedsheet, and in particular to a bedsheet having the appearance of a conventional bedsheet, but which includes a removable section that can be changed when soiled without the need to change the entire sheet.

2. Description of the Prior Art

Various bed coverings have been described in the prior art for preventing water and other forms of moisture from penetrating through the lower bedsheet and damaging the bed mattress or other bedding. Generally, these bed coverings are comprised of a water-resistant covering that is placed on the bed beneath the user. As used herein, the term "water-resistant" is intended to include materials that completely prevent water penetration, as well as materials that allow a small amount of moisture to penetrate under some conditions. The water-resistant covering may be directly in contact with the user, or covered by a water-resistant sheet. This water-resistant sheet can be uncomfortable when directly in contact with the user. While, the discomfort is reduced by covering the water-resistant sheet with a water-permeable covering, there is the necessity to remove the water-permeable covering when it is soiled.

The prior art also attempts to address the problem by using moisture-absorbent pads that are placed on the bedding material directly beneath the user. These pads serve to absorb a large quantity of liquid, but are also uncomfortable to the user, and tend to slide about, allowing moisture to reach the bedding. For example, U.S. Pat. Nos. 4,961,982 to Taylor, 5,252,374 to Larsonneur, and 4,097,943 to O'Connell describe various constructions for absorbent bed pads comprised of a permeable top covering, a water-resistant bottom covering, and a water absorbent center section, preferably of a fibrous material.

Various combinations of water-proof bed coverings and adsorbent pads have been previously described. For example, U.S. Pat. No. 4,064,577 to Walters describes a bed covering comprised of a non-waterproof draw sheet, a water-resistant panel bonded to the draw sheet, and a water-absorbent pad removable attached to the panel, e.g., with hook and loop fasteners. The pad is positioned directly in contact with the user. The pad can be removed and laundered without the need to launder the entire sheet. The draw sheet can be placed over all or a central section of a regular bedsheet.

U.S. Pat. No. 5,249,320 to Moretz et al describes a bedsheet and pad with a wicking top sheet, an absorbent central section, and a waterproof bottom sheet.

U.S. Pat. No. 4,922,565 to Blake describes a composite cover sheet for a crib comprised of a waterproof section covered by a fabric sheet. The composite sheet is secured to the crib with hook and loop fastener. Until the present invention, however, no bedsheet design has been proposed that would be comfortable to the user, protective of the bedding, and yet be easy to change when soiled. Moreover, no structure has been proposed that provides these advantages while still having the appearance of a single bedsheet of conventional construction. It is the purpose of the present invention to provide a solution exhibiting all of these features.

SUMMARY OF THE INVENTION

The present invention is directed a composite absorbent bedsheet, e.g., for use by bed wetters or patients in hospitals or nursing homes. The bedsheet, which is designed to be placed under the user and in normally used with another bedsheet that is placed over the user, is comprised of a bottom sheet component, which may be flat or fitted, having a water-resistant central section; a water absorbent pad positioned on the central section; and a cover sheet fitted over the absorbent pad and the central section. The cover sheet component is held in place by a releasable attachment material such as hook and loop fasteners, e.g., Velcro.

A construction of this nature has several advantages over the prior art. First, when the sheet is wet or soiled, removal and replacement of the entire bedsheet is not required. Instead, it is only necessary to remove and replace the cover sheet component and the absorbent pad. The cover sheet component can then be laundered and reused, while the adsorbent pad will normally be disposed of in a proper manner.

In addition, since the entire upper surface of the bed is covered by either the upper and lower sections of the bottom sheet component that are on either end of the water-resistant section, or by the cover sheet component, the comfort to the user is comparable to that of a regular bedsheet. When the upper and lower sections of the bottom sheet component and the cover sheet component are formed of the same textile material, the appearance of the bedsheet is also similar to a regular bedsheet formed of a single textile fabric or sheet, thus disguising the absorbent nature of the sheet, which is an important factor to many hospital and nursing home patients, and especially to young children who are prone to bed wetting.

The bottom sheet component of the invention is comprised of a water-resistant section covering at least about the center one-third of the bedsheet. The top and bottom sections of the bottom sheet component may be of conventional water-permeable textile fabric, e.g., cotton or a blend of polyester and cotton. The top and bottom sections may be joined at their edges to the water-resistant section, or the top and bottom sections may be a part to a continuous sheet, with the water-resistant section attached to the top of the continuous sheet. The center section preferably extends entirely across the width of the bedsheet, but may of a width less that the width of the bedsheet, e.g., the width of the bed upon which the bedsheet is placed.

The water-resistant center section may be formed of a sheet of water-resistant textile or plastic material. Preferably the center section is formed of a material that is water-resistant, but breathable. A suitable material for this purpose is sold under the trademark "Gortek."

The water absorbent pad should have a length less that the distance between the upper and lower edges of the water-resistant section, and a width less that the distance between the sides of the bed upon which the bedsheet is to be placed. For example, the distance between the upper and lower edges of the pad can be from about 2 to about 4 inches less than the distance between the upper and lower edges of the water-resistant section, and the side edges of the pad can be from about 2 to about 4 inches less than the width of the bed, so that at about 1 to about 2 inches of water-resistant section is extends beyond either side of the absorbent pad.

In order to provide the comfort and appearance of a conventional lower bedsheet, the bedsheet of the invention also includes a cover sheet section to cover the water-resistant section and the absorbent pad. The cover sheet section is normally comprised of the same material as the upper and lower sections of the bottom sheet component, to provide the appearance of a single sheet. The dimensions of the cover sheet section should be at least as large as the dimensions of the water-resistant section, so that no part of the water-resistant section will be exposed. Preferably, the dimensions of the cover sheet section are equal to the dimensions of the water-resistant section.

To ensure that the cover sheet remains in place, a fastener or attachment means is used to releasibly attach the cover sheet to the water-resistant section. Preferably, the attachment means is positioned adjacent at least two opposed edges, e.g., the upper and lower edges, of the water-resistant section, and preferably around all edges of the water-resistant section. A suitable material for this purpose is hook and loop fastener material of the type sold under the trademark "Velcro." When using this material, either the hook or loop section of the fastener material is secured to the water-resistant sheet section, and the other section is secured to the lower edge of the cover sheet component.

When used, the bottom sheet component is placed on a bed with the attachment means on the upper side of the sheet. The edges of the bottom sheet component are tucked under the mattress in the usual way that a conventional bottom sheet is placed on a bed. The absorbent pad is placed on the water-resistant center section of the bottom sheet component between the attachment means sections. The cover sheet component is then placed over the center section and absorbent pad, and secured in place with the attachment means. Securing of the cover sheet component not only serves to prevent the cover sheet component from shifting, and thus exposing a part of the water-resistant section, but also serves to hold the absorbent pad in place on the water-resistant section.

The composite bedsheet of the present invention has the comfort and appearance of a conventional single, bottom sheet. When wet or soiled, however, removal and replacement of the entire sheet is not required. Instead, it is only necessary to separate the attachment means, and remove the cover sheet component and absorbent pad. Any moisture on the water-resistant sheet can then be wiped away, with or without a suitable disinfectant, and a new absorbent pad and cover sheet component can be placed on the water-resistant pad. The soiled pad is normally disposed of, while the cover sheet component can be laundered and reused.

Accordingly, one aspect of the present invention is to provide a moisture-resistant bedsheet for use on a bed beneath the user comprising a bottom sheet component having a moisture-resistant center section; a moisture absorbent pad on the center section; and a cover sheet component over the pad and the center section.

It is another aspect to provide a moisture resistant bedsheet for placement on a bed having a given width and a given length comprising a bottom sheet component having water-permeable upper and lower textile sections, and a moisture-resistant center section between the upper and lower sections; attachment means adjacent at least two opposed edges of the moisture-resistant center section; a moisture absorbent pad on the center section between the attachment means; and a textile cover sheet component over the pad and the center section, the cover sheet component being secured to the bottom component with the attachment means.

These and other aspects of the present invention will become apparent to those skilled in the art after a reading of the following description of the preferred embodiment.

DETAILED DESCRIPTION OF THE INVENTION

Figure 1:
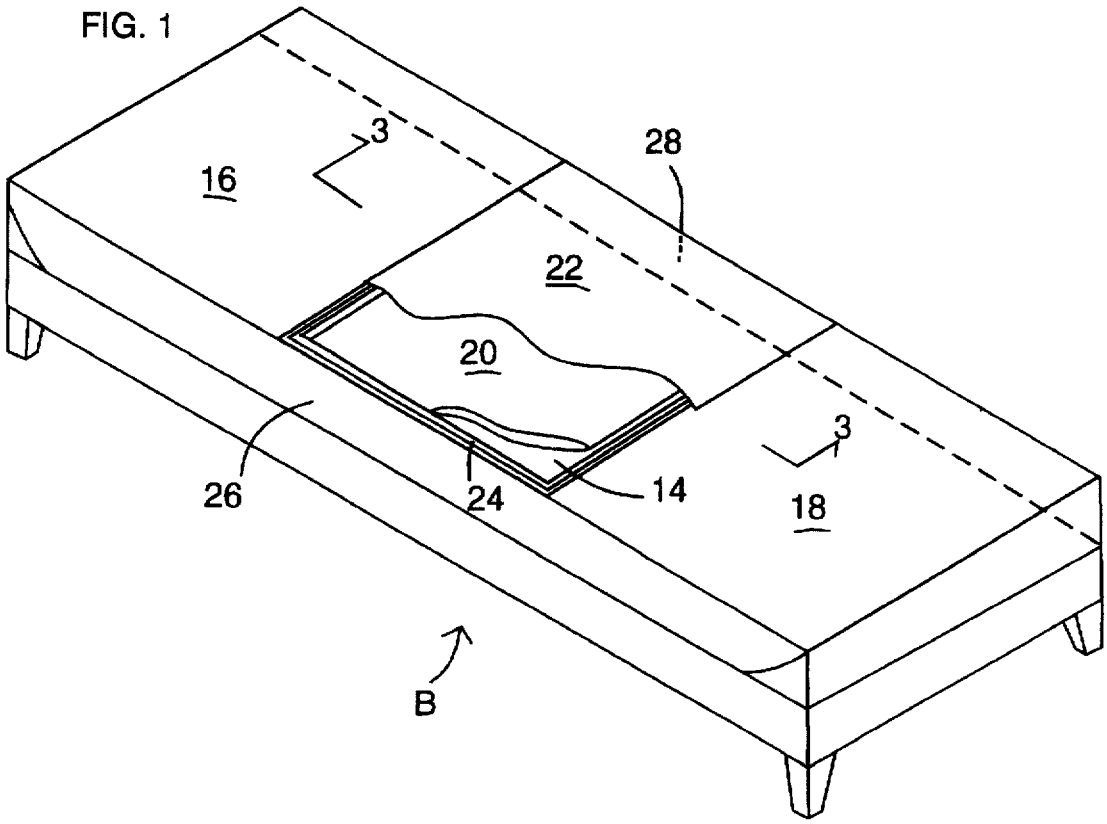
FIG. 1 is a perspective view of the bedsheet on a bed, with parts of the sheet cut away to expose its components.
Figure 2:
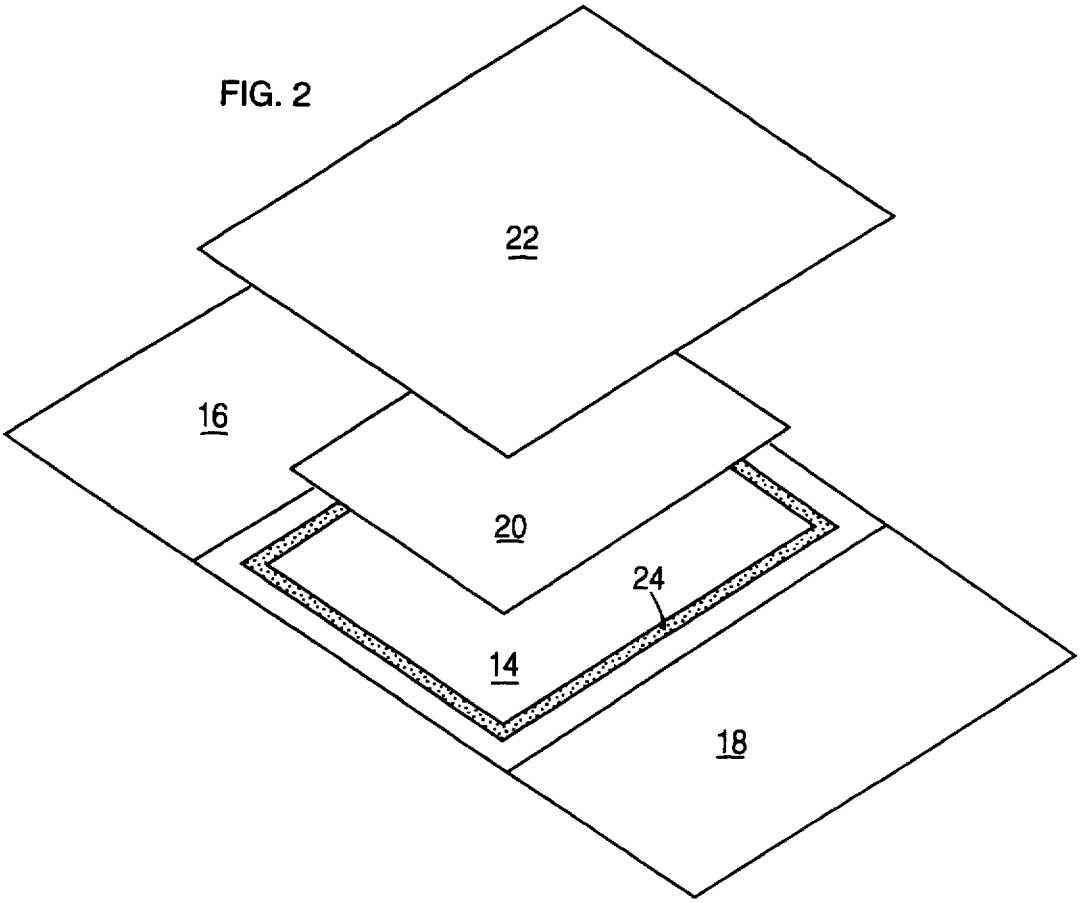
FIG. 2 is an exploded perspective view of an alternative embodiment of the bedsheet.
Figure 3:
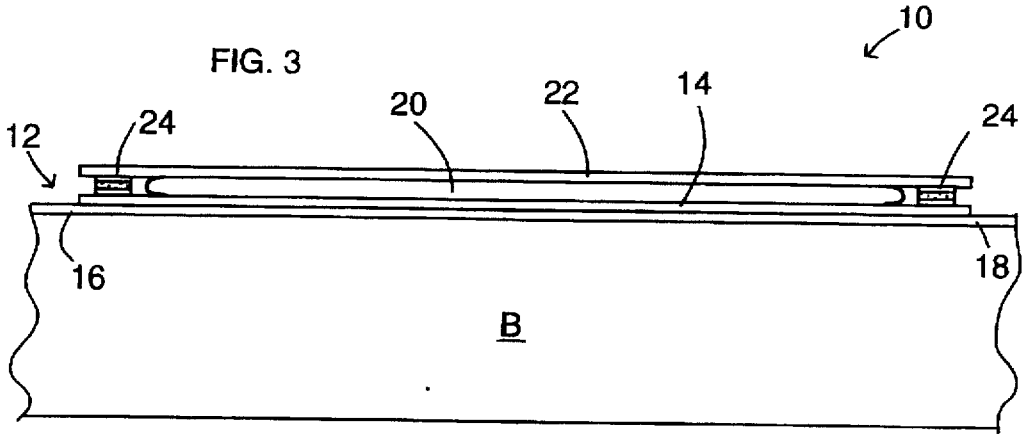
FIG. 3 is a sectional side view of the bedsheet along line 3—3 of FIG. 1.

In the following description, terms such as horizontal, upright, vertical, above, below, beneath, and the like, are used solely for the purpose of clarity in illustrating the invention, and should not be taken as words of limitation.

The present invention is bedsheet, generally 10, comprised of a bottom sheet component 12, that includes a water-resistant central section 14, and upper and lower water-permeable textile sections 16 and 18; a water absorbent pad 20, positioned on the central section 14; a water-permeable textile cover sheet component 22 fitted over pad 20 and central section 14; and hook and loop fastener strips 24 to secure sheet 22 to section 14.

Bottom sheet component 12 is sized to fit bed B. Water-resistant section 14, having parallel upper and lower edges, forms approximately the central one-third of bottom sheet component 12, or a sufficient part of the bottom sheet component to extend beneath the central part of the user's body. Upper and lower sections 16 and 18 of bottom sheet component 12 are joined to the upper and lower edges, respectively, of sheet component 12. As best seen in FIG. 1, water-resistant section 14 only extends to the sides of bed B. Thus, bottom sheet component 12 also includes side panels 26 and 28 attached to opposed side edges of section 14.

Instead of using separate parts for textile sections 16, 18, 26 and 28, these sections can be formed of a single continuous textile sheet, with water-resistant section 14 being sewn or otherwise attached to the top of the single sheet in the desired position. In this alternative, the bottom sheet component will be formed of a continuous textile sheet section having a dimension to fit the bed, and a water-resistant section attached to the central area of the upper part of the sheet section.

Water absorbent pad 20, which has a length, or top to bottom dimension, less than the distance between the upper and lower edges of the water-resistant section, and a width, or side to side dimension, less than the distance between the sides of bed B, is positioned in the center of water-resistant section 14. One section of hook and loop fastener 24 extends around the top edges of water-resistant section 14 beyond the outside edges of pad 20.

Cover sheet component 22, with the corresponding section of hook and loop fastener 24 secured to its lower surface adjacent its edges, is positioned over pad 20. Cover sheet component 22 has dimensions the same as water-resistant section 14, so that hook and loop sections 24 are joined to secure cover sheet component 22 in place, hiding water-resistant section 14, and holding pad 20 in position.

As best seen in FIG. 1, assembled sheet 10 has the comfort and appearance of a conventional single, bottom sheet. When wet or soiled, however, only cover sheet component 22 and pad 20 require replacement, making the chore of the nurse or parent less burdensome and faster.

Certain modifications and improvements will occur to those skilled in the art upon a reading of the foregoing description. By way of example, the water-resistant central section can be larger or smaller than one-third of the sheet, so long as sufficient material is available to protect the bedding beneath the sheet. It should be understood that all such modifications and improvements have been deleted herein for the sake of conciseness and readability but are properly within the scope of the follow claims.

What is claimed is:

1. A moisture-resistant bedsheet for placement on a bed having a given width and a given length comprising:

a) a bottom sheet component having water-permeable upper and lower textile sections, and a moisture-resistant center section between the upper and lower sections;

b) hook and loop fastener attachment means adjacent at least two opposed edges of the moisture resistant center section;

c) a moisture absorbent pad on the center section between the attachment means; and d) a water-permeable textile cover sheet component over the pad and the center section, the cover sheet component being secured to the bottom sheet component by hook and loop fastener attachment means secured to its lower surface adjacent its edges, whereby the hook and loop fastener sections of the bottom sheet component and the cover sheet component are joined to secure the cover sheet component in place, hiding the moisture-resistant section, and holding the moisture absorbent pad in position.

2. The bedsheet of claim 1, wherein the moisture-resistant center section is made of waterproof, breathable textile fabric.

3. The bedsheet of claim 1, wherein the cover sheet component and the top and bottom sections are made of the same material.

4. The bedsheet of claim 1, wherein the moisture-resistant center section has a width approximately equal to the width of the bed.

5. The bedsheet of claim 1, wherein the moisture-resistant center section has a width approximately equal to the width of the bedsheet.

6. The bedsheet of claim 1, wherein the moisture-resistant center section has a length approximately equal to one-third of the length of the bedsheet.

7. The bedsheet of claim 1, wherein the absorbent pad includes a water-permeable upper covering, a water-resistant lower covering, and a fibrous filler between the upper and lower coverings.

* * * * *